US008313586B2

(12) United States Patent
Edenhofer et al.

(10) Patent No.: US 8,313,586 B2
(45) Date of Patent: Nov. 20, 2012

(54) METHOD AND DEVICE FOR THERMAL TREATMENT OF METALLIC MATERIALS

(75) Inventors: Bernd Edenhofer, Kleve (DE); Hendrik Grobler, Bedburg-Hau (DE); Peter Haase, Isselburg (DE)

(73) Assignee: Ipsen International, GmbH, Kleve (DE)

( * ) Notice: Subject to any disclaimer, the term of this patent is extended or adjusted under 35 U.S.C. 154(b) by 555 days.

(21) Appl. No.: 12/487,340

(22) Filed: Jun. 18, 2009

(65) Prior Publication Data

US 2009/0314388 A1 Dec. 24, 2009

(30) Foreign Application Priority Data

Jun. 20, 2008 (DE) ..... 10 2008 029 001

(51) Int. Cl.
*C23C 8/20* (2006.01)
*C21D 11/00* (2006.01)

(52) U.S. Cl. ..... 148/216; 148/206; 266/80

(58) Field of Classification Search ..... 148/216, 148/206; 266/80
See application file for complete search history.

(56) References Cited

U.S. PATENT DOCUMENTS

| | | | | |
|---|---|---|---|---|
| 3,252,694 | A | 5/1966 | Davis, II et al. | |
| 3,620,518 | A | 11/1971 | Dornigheim et al. | |
| 4,294,436 | A | 10/1981 | Takahashi | |
| 5,098,070 | A | 3/1992 | Takahashi | |
| 5,133,813 | A | 7/1992 | Nanba et al. | |
| 5,298,090 | A * | 3/1994 | Garg et al. | 148/208 |
| 5,645,808 | A | 7/1997 | Krause | |
| 5,759,499 | A | 6/1998 | Bourdet et al. | |
| 7,560,657 | B2 | 7/2009 | Dougherty et al. | |
| 2006/0081567 | A1 | 4/2006 | Dougherty et al. | |

FOREIGN PATENT DOCUMENTS

| | | | |
|---|---|---|---|
| DE | 3632577 | A1 | 5/1988 |
| DE | 4005710 | C1 | 8/1990 |
| DE | 69013997 | | 5/1995 |
| DE | 4416469 | C1 | 7/1995 |
| DE | 69401425 | | 6/1997 |
| DE | 29908528 | U1 | 9/1999 |
| DE | 69133356 | | 12/2004 |
| EP | 0322932 | A2 | 5/1989 |
| GB | 1069531 | | 5/1967 |
| JP | 62199761 | | 8/2009 |

OTHER PUBLICATIONS

"Protective gas." babelfish.yahoo.com. Mar. 20, 2012.*
"Schutzgas." babelfish.com. Mar. 20, 2012.*

* cited by examiner

*Primary Examiner* — Jessee R. Roe
(74) *Attorney, Agent, or Firm* — James E. Walton; Richard G. Eldredge

(57) ABSTRACT

A method and a device for the heat treatment of metal materials in an industrial furnace involves a heating chamber having a treatment chamber and a quenching chamber utilizing protective gas and reaction gas.

20 Claims, 1 Drawing Sheet

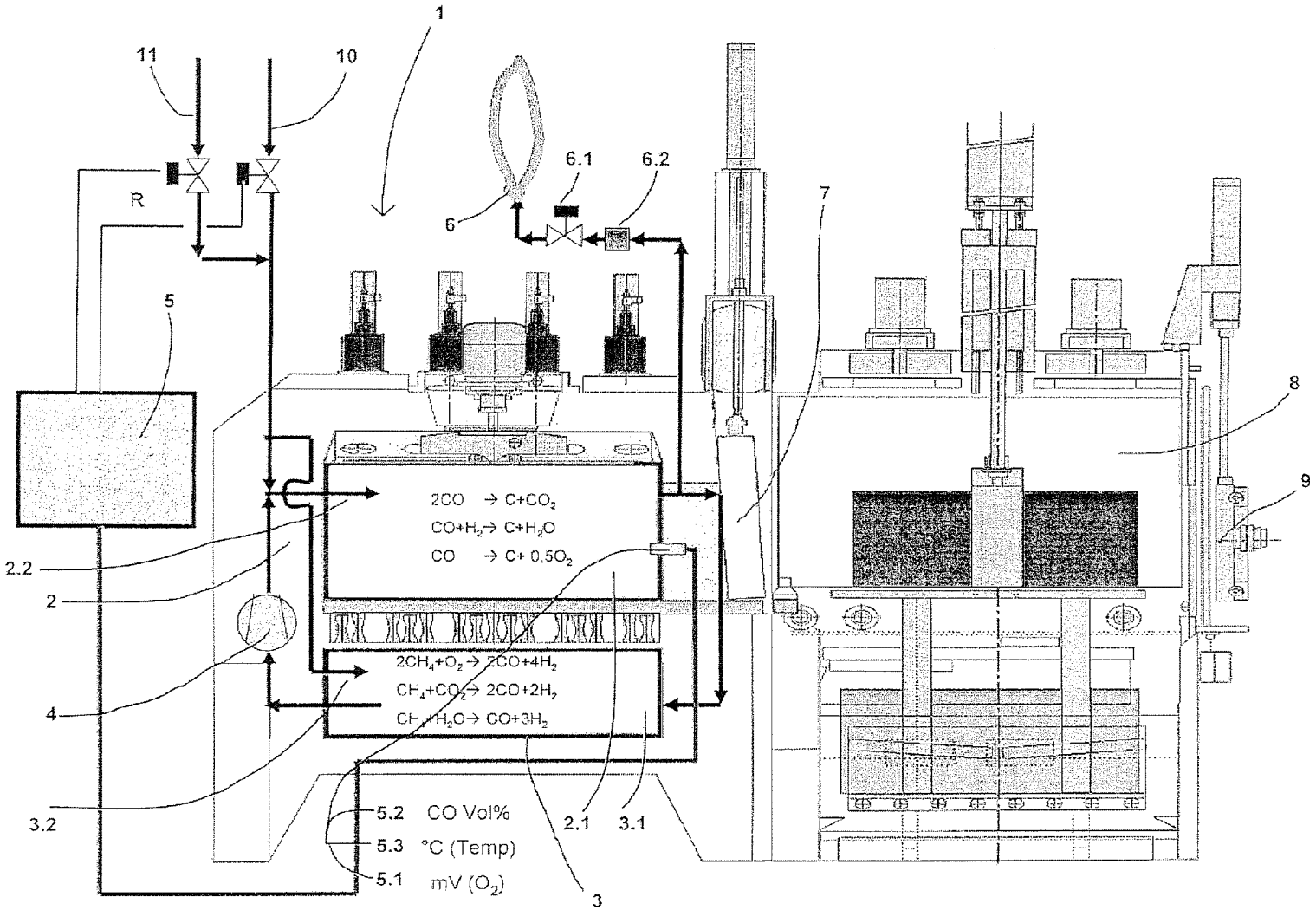
1
2
2.1
2.2
3
3.1
3.2
4
5
5.1
5.2
5.3
6
6.1
6.2
7
8
9
10
11
R
2CO → C+CO2
CO+H2 → C+H2O
CO → C+ 0,5O2
2CH4+O2 → 2CO+4H2
CH4+CO2 → 2CO+2H2
CH4+H2O → CO+3H2
CO Vol%
°C (Temp)
mV (O2)

METHOD AND DEVICE FOR THERMAL TREATMENT OF METALLIC MATERIALS

This application claims priority under 35 U.S.C. §119 of German Patent Application No. DE 102008029001.7, filed 20 Jun. 2008.

BACKGROUND

1. Field of the Invention

The subject application relates to a method and a device for the heat treatment of metal materials in an industrial furnace comprising a heating chamber having a treatment chamber and a quenching chamber utilizing protective gas and reaction gas.

2. Description of Related Art

In order to carry out the heat treatment of metal materials in industrial furnaces it is already known to utilize catalysts for heat treatment furnaces in order to accelerate the reaction kinetics by means of catalyst support.

Among others, DE 36 32 577 describes catalyst beds, DE 38 88 814 describes catalyst-like linings having mesh-like structures of furnaces, DE 40 05 710 describes fully metallic oxidation catalysts containing Ni, Mn, Cr, and Fe, and DE 44 16 469 describes a two-stage nitro-carburizing by means of Ni or Cu catalysts.

DE 691 33 356 also assumes according to expert knowledge the utilization of catalysts in heat treatment furnaces for gas carburizing methods.

The further improved technologies utilized a catalytic stirring device in furnace atmospheres according to DE 690 13 997; a catalyst part on the basis of nickel oxide in furnaces for the heat treatment according to DE 694 01 425, and a catalyst device being connected to a heat treatment system according to DE 299 08 528.

Upon further pursuing the development trend the following can be determined:

the heat treatment of metals in a carbonized atmosphere according to GB 1,069,531;

the treatment of the surfaces of materials in annealing furnaces having a catalyst lining made of Ni oxide according to U.S. Pat. No. 3,620,518, which is attached to the ceramic interior wall and which enlarges the available surface;

utilizing a furnace for the heat treatment of metal parts having a protective atmosphere in furnaces having catalytic walls made of Ni according to U.S. Pat. No. 4,294,436;

the catalytic oxidation utilizing carbon compounds in gas flows according to U.S. Pat. No. 5,645,808;

the material treatment supported by plasma according to US 2006/0081567, and according to JP 62199761; and the heat treatment and carburizing processes in a furnace having catalysts of any type seem to be completed, which is verified by further examples of prior art.

In summary, methods and furnaces for gas carburizing, having fireproof linings, metal catalysts made of Ni, Cu, Mn, Cr, Fe, etc, and also platinum, catalytic layers on ceramic linings, mesh-like catalyst linings, and catalytic stirring devices, and/or surface enlargements of the catalytic lining are largely known.

All of said methods and devices limit the savings of protective gas, the reduction of heat energy loss, and a supply of e.g. C/natural gas for carburizing that is tailored to specific requirements, and adjusting the C potential in the protective gas and excluding any non-adjustable/undesirable reactions, said limitations having obtained only few advantages in the further embodiment of the catalysts in industrial furnaces with regard to the construction thereof.

According to this documented prior art, the operation of the heat treatment of metal materials under protective gas is categorized in practice in the same manner as the gas carburizing such that the heat treatment furnace is aerated utilizing a reducing protective gas. This protective gas is usually composed of carbon monoxide, hydrogen, water vapor, carbon dioxide, and nitrogen. The introduction of aeration occurs in the heating chamber. In general a cold treatment chamber, a so-called quenching chamber, is connected to said heating chamber. Both chambers are usually separated by a gas permeable door. The gas fed into the heating chamber therefore also reaches the cold treatment chamber. However, the protective gas is guided out of the same at a burnout point, is safely ignited by an ignition burner, and burned.

This process is a continuous rinsing process, which, however, is associated with consistently high gas losses at the burnout point of the cold treatment chamber. However, this type of continuous rinsing of the heat treatment furnace is currently necessary in order to rinse any undesired gases penetrating the furnace after opening the door, such as air, out from the furnace again, or to also be able to carry out quick C potential modifications (atmosphere change), and in order to maintain a quasi stationary balance within the heating chamber. Without continuous rinsing the concentrations of carbon dioxide, oxygen, and water vapor would constantly rise in the heating chamber as the products of carburizing reactions with the components, since the degeneration reactions are executed in a slower manner using fed natural gas, than the carburizing reactions. This would mean that the carbon level would continuously drop, although, for example, natural gas would have been fed as the reaction gas for enrichment. The carbon potential does not become controllable until said rinsing, e.g. a maintaining of constant gas concentrations with regard to CO and $H_2$ is carried out.

The practical knowledge confirms the previously described disadvantages of current methods, according to which the permanently high gas loss by means of rinsing the furnace, the energy loss of the protective gas value, and also the loss of process heat through the open system occur.

Thus, a much higher carbon mass stream is lost during carburizing due to rinsing, than is even required in order to carburize the materials like components.

DESCRIPTION OF THE DRAWINGS

The drawing shows a simplified illustration of an industrial furnace with a schematic impression of the reaction operations of the method and the features of a construction variation of the device that is essential to the invention.

LIST OF REFERENCE SYMBOLS

1 industrial furnace
2 heating chamber
2.1 treatment chamber
2.2 first feeding points
3 processing chamber
3.1 catalyst bed
3.2 second feeding points
4 recycling device
C potential controller
5.1 $O_2$ sensor
5.2 CO analyzing device
5.3 temperature measuring device
6 burnout point
6.1 gas-tight valve
6.2 pressure regulator

7 interior door
8 quenching chamber
9 exterior door
10 feeding of hydrocarbon
11 feeding of air
R control cycle

DETAILED DESCRIPTION OF THE PREFERRED EMBODIMENT

The invention is based on the task of creating a method and a device for the heat treatment of metal materials in an industrial furnace comprising a heating chamber having a treatment chamber and a quenching chamber while maintaining generally known furnace constructions and catalysts, utilizing a first treatment medium, such as protective gas, also having the components carbon dioxide, oxygen, and water vapor in addition to the minimum components of carbon monoxide, hydrogen, and nitrogen; and a second treatment medium, such as a reaction gas, which may be utilized for a carburizing process; for the recovery of protective gas, in order to save protective gas, reduce heating energy losses, feeding a hydrocarbon, such as natural gas, to the carburizing process, and to control the C potential in the protective gas, and to exclude any uncontrollable/undesired reactions.

According to the invention the same is solved in that (a) the components carbon dioxide, oxygen, and water vapor with hydrocarbon fed as the reaction gas catalytically react to carbon monoxide and hydrogen in a processing chamber for the heating chamber of the industrial furnace, being structurally and functionally associated with the treatment chamber, and having a catalyst bed, and (b) the reactions are accelerated by means of the use of a catalyst at the catalyst bed, the protective gas then has a controlled C potential in the treatment chamber after said reactions, wherein the protective gas having been processed in this manner is fed to the treatment chamber of the heating chamber in a recycling manner.

The catalyst utilized at the catalyst bed should advantageously contain nickel, platinum, palladium, or rhodium.

In each of the active carbon transfer phases only such an amount of carbon is fed to a gas carburizing process in the form of a reaction gas, as is necessary for gas carburizing.

Natural gas is utilized as the reaction gas.

The following reactions are executed in the treatment chamber during gas carburizing $$2CO \rightarrow C + CO_2$$

$$CO + H_2 \rightarrow C + H_2O$$

$$CO \rightarrow C + 0.5O_2,$$

wherein the C potential then drops and the volume-% of $CO_2$, $H_2O$, and $O_2$ rises.

Gas enrichment is carried out in the processing chamber at the catalyst bed according to the reactions $$2CH_4 + O_2 \rightarrow 2CO + 4H2$$

$$CH4 + CO2 \rightarrow 2CO + 2H2$$

$$CH4 + H2O \rightarrow CO + 3H_2$$

wherein in this case the C potential rises, and the volume-% of $CO_2$, $H_2O$, and $O_2$ drops.

In the sense of the invention the C potential (carbon potential) is always controlled by means of gas analysis and temperature measurement.

In order to control the carbon potential air and hydrocarbon gas are utilized such that an amount of air is fed, if the C potential is to drop; in case of a desired increase of the C potential hydrocarbon gas is fed.

According to a first variation of the method the C potential present in the treatment chamber of the heating chamber is controlled after feeding of the hydrocarbon at the catalyst bed.

According to a second variation of the method the C potential present in the treatment chamber of the heating chamber is controlled by means of feeding the hydrocarbon into the treatment chamber, wherein the hydrocarbon reacts in a recycling manner at the catalyst bed.

The protective gas is then guided to a burnout point, ignited, and burned, if an impermissible pressure increase is present, wherein the operating pressure is thus regulated, or if a temporary rinsing process requires the same.

Purposefully, the working pressure is preferably 1 to 10 mbars for this purpose.

In case of a drop of operating pressure, reaction gas and air, or protective gas, can be fed accordingly. Any excess of $H_2$ possibly occurring is separated.

The method provides that a mandatorily recycled gas guidance is carried out, which is executed in a largely isothermal manner in order to avoid undesired reactions, such as the formation of soot.

The mandatorily recycled gas guidance can be carried out by means of a re-circulating gas removal from the area of the heating chamber without any gas cooling, or as an alternative by means of re-circulating gas removal from the area of the quenching chamber.

In order to carry out the method in an industrial furnace comprising the heating chamber having the treatment chamber and the processing chamber having the catalyst bed and the quenching chamber, the invention provides a device having (a) a C potential controller carrying out a gas analysis and corresponding with the processing chamber; (b) a recycling device for the cycle of a re-circulating protective gas having a controlled feeding of air and reaction gas, and (c) a gas-tight valve at a burnout point, having a pressure regulator and the function of gassing in case of a pressure drop; wherein the said components (a) to (c) are functionally integrated in the control cycle.

An interior door closing the heating chamber from the quenching chamber in a gas-tight manner is arranged when removing gas from the area of the heating chamber.

On the other hand an interior door closing in a gas-permeable manner is arranged between the heating chamber and the quenching chamber when removing gas from the area of the quenching chamber, wherein in this case the quenching chamber must have an exterior door closing in a gas-tight manner.

The treatment chamber has first feeding points for feeding the recycled protective gas and/or for feeding the hydrocarbon.

The processing chamber has second feeding points for feeding the hydrocarbon.

The processing chamber having the catalyst bed may be locally separated from the treatment chamber.

As a functional requirement the C potential controller comprises an $O_2$ sensor, a CO analyzing device and a temperature measuring device.

The subject application is therefore aimed at a novel protective gas circulation system for gas carburizing, wherein the components carbon dioxide, oxygen, and water vapor catalytically react with a fed hydrocarbon, such as natural gas, back to a carbon monoxide and hydrogen.

The recycling of already "consumed" protective gas, e.g. an protective gas having a low C potential, is advantageous.

The degeneration reactions are carried out with the support of a catalyst in an accelerated manner, wherein suitable catalysts must be utilized for this purpose.

The C potential control illustrated as an alternative can be advantageously carried out by means of atmospheric analysis. The "processed" protective gas can then be re-fed to the feeding point such that a real cycle process is created and the gas carburizing is continued.

The installation requirements for this recirculation system may be fulfilled by means of a gas-tight interior door, or a gas-tight exterior door, depending on the variation of the method. The burnout by means of a gas-tight valve must still open in the furnace at impermissible pressure increases in order to control the operating pressure. For this purpose the working pressure should be between 10 and 100 mmWS, or 1 to 10 mbars.

In order to increase pressure again in case of a drop in operating pressure, for example, natural gas and air or protective gas can be fed at a suitable amount.

In case of an impermissibly high hydrogen concentration in the furnace, which may occur during the feeding of a large amount of hydrocarbon, hydrogen must be removed from the process by means of suitable measures.

The advantages of the method are a massive savings of protective gas. The heating energy losses by means of burnout can be reduced to a minimum. Also, only such an amount of carbon needs to be fed in each carbon transfer phase of the carburizing process, as is required for gas carburizing.

Another advantage is the control of the C potential according to the variations disclosed. The carburizing of components based on direct hydrocarbon dissociation is therefore excluded.

The gas guidance can be carried out in a largely isothermal manner in order to avoid undesired reactions, such as the occurrence of soot.

Therefore, a catalytic in-situ protective gas creation controlled by a C potential functionally melts in combination with a flow recirculation in a heat treatment furnace into a surprisingly novel effect having the illustrated advantageous properties.

It is typical for the method that in detail the process steps of the heat treatment are linked to the steps of protective gas recycling.

Due to the fact that an excess of $H_2$ possibly occurring can be separated, the process operation is not adversely affected.

In fulfilling the task the method introduces the effect that particularly in each carbon transfer phase of the carburizing process only such an amount of carbon in the form of, for example, natural gas, is fed as is required for gas carburizing and that carburizing workpieces based on $CH_4$ dissociation is excluded.

As opposed to the solutions provided by prior art examined above, in which the embodiments and functions of the catalysts have been the main focus of the further improvements, a qualitative novel process effect of gas guidance has been developed with the invention according to the method.

If the person skilled in the art analyzes the entirety of the advantageous effects according to the present application, it must be noted that the disadvantages asserted above, such as the high gas losses at the burnout point of the cold treatment chamber associated with the continuous rinsing process, or the drop of the carbon level, although the reaction gas, for example, natural gas, is introduced for enrichment, or the energetic loss of the protective gas heat value and also the loss of process heat through the open system, or the additional expenditures of the carbon mass flow required during carburizing due to rinsing, no longer occur according to the invention.

The drawing outlines in a simplified illustration an industrial furnace 1 commonly used in practice, which comprises a heating chamber 2 having a treatment chamber 2.1 and a processing chamber 3 having a catalyst bed 3.1, and an associated quenching chamber 8.

In this example the processing chamber 3 having the catalyst bed 3.1 is structurally connected to the treatment chamber 2.1, however, it may also be locally separated and functionally associated, the structural design of which is not illustrated herein.

Those materials and constructions known from prior art may be utilized as the materials and constructions for the catalyst bed 3.1, as can the systems of catalysts known from automotive engineering.

It is typical for the invention, however, that the device for carrying out the method for the heat treatment of metal materials according to the present application intended for the industrial furnace 1 by means of the protective gas recycled according to the invention comprises the following: (a) a C potential controller 5 having an $O_2$ sensor 5.1, a CO analyzing device 5.2, and a temperature measuring device 5.3, which correspond to the catalyst bed 3.1; (b) a recycling device 4 for the cycle of the re-circulating protective gas having a controlled feeding of air 11 and natural gas 10; and (c) a gas-tight valve 6.1 at a burnout point 6 having a pressure regulator 6.2 and having the function of gassing during a drop in pressure.

Said components form a functional control cycle R, which is an essential part of the invention for the device.

With regard to the method it is necessary to associate first feeding points 2.2 with the treatment chamber 2.1 for feeding the recycled protective gas and/or for feeding the hydrocarbon, and associating second feeding points 3.2 with the processing chamber 3 for the feeding of the hydrocarbon.

The function of the first feeding points 2.2 is therefore determined for the operations of feeding of the protective gas; feeding of the protective gas or feeding of the hydrocarbon; feeding of the protective gas and feeding of the hydrocarbon depending on the process and structural embodiment.

In this example an interior door 7 closing in a gas-tight manner for the removal of gas in a re-circulating manner from the area of the heating chamber 2 without gas cooling is arranged between the heating chamber and the subsequent quenching chamber 8. In the structural variation not illustrated herein the interior door 7 closing in a gas-permeable manner for the removal of gas from the area of the quenching chamber 7 is arranged between the heating chamber 2 and the quenching chamber 8, however, the quenching chamber 8 is equipped with an exterior door 9 closing in a gas-tight manner. Both structural variations are an essential part of the invention for the method as opposed to the so-called open systems and gas-permeable doors described in prior art, and also support the system of the control cycle R in the function thereof according to the method.

The novel method, wherein protective gas is recovered, is carried out in the industrial furnace 1 according to the invention described above according to the following process steps:

In the processing chamber 3 of the industrial furnace 1 having the catalyst bed 3.1 the components carbon dioxide, oxygen, and water vapor fed as the protective gas catalytically react with the fed reaction gas, such as natural gas, to carbon monoxide and hydrogen.

If necessary, the C potential is controlled by means of the C potential controller 5 having the $O_2$ sensor 5.1, the CO analyzing device 5.2, and the temperature measuring device 5.3 such that the processed protective gas can be returned to the treatment chamber 2.1 at first feeding points 2.2 in a re-circulating manner.

For this purpose the reactions in the treatment chamber 2.1 are carried out according to $$2CO \rightarrow C + CO2$$

$$CO + H2 \rightarrow C + H2O$$

$$CO \rightarrow C + 0.5O_2,$$

wherein the C potential drops, and the volume-% of $CO_2$, $H_2O$, and $O_2$ rise.

At the catalyst bed 3.1, e.g. in the processing chamber 3, which is located in the bottom part of the heating chamber 2 in this example, the enrichment according to the reactions $$2CH_4 + O_2 \rightarrow 2CO + 4H_2$$

$$CH_4 + CO_2 \rightarrow 2CO + 2H_2$$

$$CH_4 + H_2O \rightarrow CO + 3H_2,$$

is again carried out, wherein the C potential rises and the volume-% of CO2, H2O, and O2 drops again.

These reactions therefore fulfill the requirements of the desired recycling of protective gas according to the invention, which is now incorporated in the heat treatment process in a re-circulating manner.

From the point of view of the person skilled in the art these reactions should be understood such that, of course, air and known hydrogen gas are also utilized for controlling the carbon potential. This means that an amount of air is supplied, if the C potential is to drop; otherwise a hydrocarbon gas is fed, if the C potential is to be increased.

For this purpose the controlling of the C potential present in the treatment chamber 2.1 is also provided after feeding the hydrocarbon via the second feeding points 3.1 at the catalyst bed 3.1 in order to adjust the C potential tailored to suit the requirement.

As an alternative, the controlling of the C potential present in the treatment chamber 2.1 may also be carried out via the first feeding points 2.2 in the treatment chamber 2.1 after feeding the hydrocarbon, thus creating a reaction of the hydrocarbon at the catalyst bed 3.1 in a re-circulating manner.

Optionally the protective gas may be guided to a burnout point 6, ignited, and burned, if the burnout must occur at impermissible pressure increases in order to control the operating pressure, or if a temporary rinsing process requires the same.

This may also be the case, if the treatment chamber must be rinsed, for example, during the heating phase, in order to remove any contaminants damaging the process, or also in order to carry out a gas exchange during the process, if, for example, the C potential must be quickly reduced from 1.3% C to 0.6% C.

The working pressure may preferably be 1 to 10 mbars, wherein higher pressures are possible.

In case of a drop of the operating pressure, for example, natural gas 10 and air 11, or protective gas, may be fed as the reaction gas accordingly.

It is of advantage that the process steps of the heat treatment are linked to the steps of the protective gas recycling, by means of which the actual heat treatment process can further be carried out continuously and without any delays.

Any excess of H2 possibly occurring due to the process can be separated without any problems without having to interrupt the operation of the process.

The method provides to strive for a mandatorily recycled gas guiding in an isothermal manner by means of the recycling process 4 in order to avoid any undesired reactions, such as the formation of soot.

Overall a controlled, real cycle process is therefore created according to the method, in that the processed protective gas is fed for the heat treatment by means of materials not illustrated herein in a re-circulating manner.

Commercial applicability: internal testing has confirmed the described advantages and user-friendly usability of the device as well as the realization thereof according to the method and device in an industrial furnace.

We claim:

1. A method for the heat treatment of metal materials in an industrial furnace having a heating chamber having a treatment chamber and a quenching chamber, the method comprising:

utilizing a first treatment medium, having components of carbon dioxide, oxygen, and water vapor in addition to minimum components of carbon monoxide, hydrogen, and nitrogen;

utilizing a second treatment medium utilized for a carburizing process; and providing a processing chamber in the heating chamber of the industrial furnace for the recycling of protective gas, the processing chamber being structurally or functionally associated with the treatment chamber, wherein the components carbon dioxide, oxygen, and water vapor catalytically react with fed hydrocarbon as a reaction gas to carbon monoxide and hydrogen, and the reactions are to be accelerated by utilizing a catalyst at a catalyst bed, such that the protective gas then has a controlled C potential in the treatment chamber after said reactions;

wherein the protective gas processed in this manner is then fed to the treatment chamber of the heating chamber in a re-circulating manner.

2. The method according to claim 1, wherein nickel, platinum, palladium, or rhodium is utilized at the catalyst bed as the catalyst.

3. The method according to claim 1, wherein only such an amount of carbon is fed in the form of a reaction gas for a gas carburizing process in each active carbon transfer phase, as is required for gas carburizing.

4. The method according to claim 1, wherein natural gas is utilized as the reaction gas.

5. The method according to claim 1, wherein the C potential is controlled by means of gas analysis, and a temperature measurement is carried out.

6. The method according to claim 1, wherein the C potential present in the treatment chamber of the heating chamber is controlled after feeding of the hydrocarbon at the catalyst bed.

7. The method according to claim 1, wherein the C potential present in the treatment chamber of the heating chamber is controlled by means of feeding the hydrocarbon in the treatment chamber, wherein the hydrocarbon reacts at the catalyst bed in a re-circulating manner.

8. The method according to claim 1, wherein a working pressure is between 1 to 10 mbars.

9. The method according to claim 1, wherein in case of a drop in operating pressure, reaction gas and air, or protective gas are fed accordingly.

10. The method according to claim 1, wherein any excess of $H_2$ is separated.

11. The method according to claim 1, wherein a mandatorily recycled gas guidance is carried out without any gas cooling by means of a re-circulating gas removal from the area of the heating chamber.

12. The method according to claim 1, wherein during the gas carburizing in the treatment chamber the reactions $$2CO \rightarrow C+CO_2$$

$$CO+H_2 \rightarrow C+H_2O$$

$$CO \rightarrow C+0.5O_2,$$

are carried out, wherein the C potential then drops and the volume-% of $CO_2$, $H_2O$, and $O_2$ rises, and a gas enrichment occurs in the processing chamber at the catalyst bed according to the reactions $$2CH_4+O_2 \rightarrow 2CO+4H_2$$

$$CH_4+CO_2 \rightarrow 2CO+2H_2$$

$$CH_4+H_2O \rightarrow CO+3H_2$$

wherein the C potential rises and the volume-% of $CO_2$, $H_2O$, and $O_2$ drops.

13. The method according to claim 12, wherein the processing chamber comprises:

at least one of a first feeding point and a second feeding point for feeding the hydrocarbon.

14. The method according to claim 13, wherein the processing chamber with catalyst bed is locally separated from the treatment chamber.

15. The method according to claim 1, wherein the protective gas is guided to a burnout point, ignited, and burned, if an impermissible pressure increase is present, wherein the operating pressure is thus controlled, or if a temporary rinsing process requires the same.

16. The method according to claim 15, wherein a gas-tight valve for a burnout point having a pressure regulator and the function of a gassing in case of a drop in pressure is used.

17. The method according to claim 1, wherein a mandatorily recycled gas guidance is carried out from the area of the quenching chamber.

18. The method according to claim 17, wherein a control cycle carries out at least one of the functions defined by the process steps.

19. The method according to claim 1, wherein a mandatorily recycled gas guidance is carried out, which is carried out in a largely isothermal manner in order to avoid any undesired reactions, such as the formation of soot.

20. The method according to claim 19, wherein the mandatorily recycled gas guidance for the cycle of the recirculation is carried out by means of a recycling device.

* * * * *